US005979798A

United States Patent [19]

Hall et al.

[11] Patent Number: 5,979,798

[45] Date of Patent: Nov. 9, 1999

[54] SPRAY SYSTEM FOR APPLICATION OF HIGH BUILD COATINGS

[75] Inventors: Terry L. Hall, Huntsville, Ala.; Stephen K. Bishop, Ardmore, Tenn.; Terry C. McGugin, Madison, Ala.

[73] Assignee: United Technologies Corporation, Hartford, Conn.

[21] Appl. No.: 09/080,699

[22] Filed: May 18, 1998

[51] Int. Cl.[6] ..... B05B 7/10; B05B 7/06; F23D 11/16; F23D 11/10

[52] U.S. Cl. ..... 239/400; 239/419.3; 239/422; 239/427.5

[58] Field of Search ..... 239/310, 311, 239/314, 315, 316, 318, 325, 336, 418, 400, 405, 422, 420, 419.3, 421, 424, 426, 433, 499, 424.5, 427.5, 428, 431

[56] References Cited

U.S. PATENT DOCUMENTS

| | | | |
|---|---|---|---|
| 1,935,977 | 11/1933 | Geer | 239/400 |
| 2,508,766 | 5/1950 | Morel | 239/400 |
| 2,543,517 | 2/1951 | Anderson | 239/400 |
| 2,565,696 | 8/1951 | Moller et al. | 239/336 |
| 3,185,396 | 5/1965 | Black | 239/400 |
| 3,788,555 | 1/1974 | Harrison et al. | 239/336 |
| 4,807,814 | 2/1989 | Douche | 239/428 |
| 5,002,229 | 3/1991 | Schneider et al. | 239/427.5 |
| 5,246,163 | 9/1993 | Amano et al. | 239/433 |

*Primary Examiner*—Andres Kashnikow
*Assistant Examiner*—Jorge Bocanegra
*Attorney, Agent, or Firm*—Norman Friedland

[57] ABSTRACT

Many industries such as construction and aerospace industries use high build coatings for various purposes. Spray system for applying high build coatings allow thick coating to be applied relatively quickly as opposed to manual methods. The present application provides for a spray system including a spray apparatus having a conveyance device which provides a motive force created by a vacuum for delivering a dry material to the nozzle of the apparatus, the conveyance device including an array of bores for separating the dry material to provide substantially uniform wetting of the dry material when the dry material enters the nozzle. The conveyance device is particularly useful in applying plaster and stucco. The present apparatus eliminates concerns of pot-life, waste and product uniformity by wetting the dry material close to the nozzle outlet.

11 Claims, 2 Drawing Sheets

SPRAY SYSTEM FOR APPLICATION OF HIGH BUILD COATINGS

BACKGROUND

1. Technical Field

The present application relates to high build coatings, such as plaster and stucco, and more particularly to an apparatus for application of high build coatings.

2. Background of Related Art

Many industries, such as the construction and aerospace industries, have a need to apply high build coatings. High build coatings are coatings with a finished thickness from about 0.060" to 2.000" and weights ranging from approximately 2 lbs/cubic foot to 100 lbs/cubic foot. Plaster and stucco are examples of two high build coatings which are frequently used in the construction industry for aesthetic and structural purposes, as well as for fireproofing. Plaster and stucco coatings are mixtures of hygroscopic binders, fillers and water. Plaster is typically an interior coating based on gypsum, while stucco is traditionally an exterior coating which is usually based on portland cement, but also has been made with other hygroscopic materials such as gypsum. The fillers are typically materials such as cork, vermiculite, glass fibers, styrofoam beads, phenolic microballoons, glass microballoons, and cellulose fibers.

Traditional application techniques required manual mixing of the plaster and/or stucco in a barrel, or pot, with the mixed material being applied manually. Manual application had many disadvantages including a short pot-life of the material and the labor required to apply the material.

Because thickness up to about 2.00" are regularly required for high build coatings, spray systems have been developed to apply high build coatings more quickly than manual application allows. Prior art spray systems generally include a bin or hopper for holding a dry material which typically includes the hydroscopic material and a filler, a nozzle for wetting the dry material, a flexible conduit extending between the bin and the nozzle and an apparatus for generating a motive force to move the dry material from the bin or hopper through the conduit and out the nozzle. The prior art spray system may include two bins, one for holding the hydroscopic binder and one for the filler material, and a mixing device for combining the dry materials either prior to entry into the conduit or along the conduit, after entry.

Such prior art spray systems feed the dry material to the nozzle, which then wets the dry material, and ejects the wetted material onto the substrate thereby coating it. Typically the dry material comprises the hydroscopic material and a filler. Properties of the coating deposited are dependent on water control, the degree of wetting, uniformity of the hydroscopic material/filler distribution and filling timing.

One problem associated with typical prior art spray systems stems from the means used to generate the motive force. Two such means are a compressor and an eductor connected to the bin. The compressor forces the dry material out of the bin through the conduit and nozzle using pressurized air. The eductor creates a low pressure upstream of the eductor that draws the dry material out of the bin.

The means for generating the motive force can be placed at the upstream end of the conduit or the downstream end of the conduit. Eductors and compressors placed at the upstream end of the conduit push the dry material through the conduit. The problem with pushing the dry material through the conduit is that line losses are experienced, material separation according to particle size occurs, and fall-out occurs. All of which results in a non-uniform mixture passing through the nozzle which consequently inhibits wetting of the dry material and therefore decreases the properties of the coating.

To solve the problems of upstream eductors and compressors, eductors have been placed at the downstream end of the conduit, such as the granular material emitting means shown in U.S. Pat. No. 3,788,555. The granular material emitting means comprises an elongated, substantially tubular main body portion and an elongated tubular branch portion. The axis of the bore of the branch portion intersects the axis of the bore of the main body portion at an acute angle of about 30° to about 80°, with 30° to 60° being preferable. One end of the bore of the branch portion is connected to a suitable source of fluid under pressure and one end of the tubular main body portion is connected to granular material reservoir through a conduit. During operation, the fluid under pressure flows through the branch portion and the acute angle is sufficient to cause the flow of the fluid to provide an area of reduced pressure upstream of the junction between the bore of the main body portion and the bore of the branch portion. This reduced pressure tends to cause the granular material to be withdrawn from the reservoir, entrained in the fluid, and carried through the conduit to the main body portion and out of the granular emitting means.

The downstream eductor of the aforementioned patent has the benefit of pulling the granular material all the way up the conduit, thus no line losses, material separation or fallout should be experienced. However, the downstream eductor above has two problems with respect to applying high build coatings. The granular material for use with the granular emitting device are perlite, clay, sand, talc, mica, calcium carbonate, calcium silicate, glass beads, plastic spheres and the like. These materials all weigh less than the hydroscopic materials necessary to form high build coatings; therefore, the motive force requirements necessary for the granular emitting means are less than those necessary for forming high build coatings.

Another problem associated with the spray apparatus disclosed in the aforementioned patent is that convergent nozzles are used to mix the granular material with a plural component material, such as a resin and a curing agent external to the spray apparatus. The use of convergent mixing external to the spray apparatus is necessary in the Harrison patent because the resin and curing agent turn from liquid to solid upon contact with the atmosphere; therefore mixing outside the spray apparatus is necessary to prevent clogging of the apparatus. However, it is desired that high build materials be mixed within the nozzle in order to optimize wetting and exercise greater control of pressure, turbulence and impingement angles.

A need therefore exists for a spray apparatus to apply coatings of hygroscopic material and filler, which exerts sufficient motive force on dry material to move it and which maintains this force throughout length of conduit, while substantially uniformly wetting the dry material within the nozzle.

The present application provides for a spray system including a conveyance device which moves the dry material through a conduit and uniformly wets the dry material within a nozzle.

BRIEF DESCRIPTION OF THE DRAWINGS

Various embodiments are described herein with reference to the drawings wherein.

These figures are meant to be exemplary and not to limit the generally broad scope of the present invention as claimed.

SUMMARY

A spray system for application of a wetted dry material is provided, the spray system including: a nozzle, the nozzle having a liquid inlet through which a liquid enters and a conveyance device attached to the nozzle. The conveyance device includes an outer enclosure which has an air inlet through which a compressed air enters and an inner enclosure disposed substantially within the outer enclosure, the inner and outer enclosure defining an air manifold therebetween. The inner enclosure includes a longitudinally extending inner bore and an array of bores disposed therethrough, the array of bores providing fluid communication of the compressed air between the air manifold and the inner bore. Each of the bores in the array has an internal diameter, the internal diameter being sufficient to allow the compressed air to flow from the air manifold through the inner bore, thereby producing a vacuum within the inner bore. The vacuum produced is of sufficient strength to transport a predetermined volume of the dry material through the inner bore to the nozzle where the dry material is wetted by the liquid, the vacuum also being sufficient to propel the wetted dry material from the nozzle onto a substrate in order to coat the substrate with the wetted dry material.

DETAILED DESCRIPTION OF THE PREFERRED EMBODIMENTS

Figure 1:
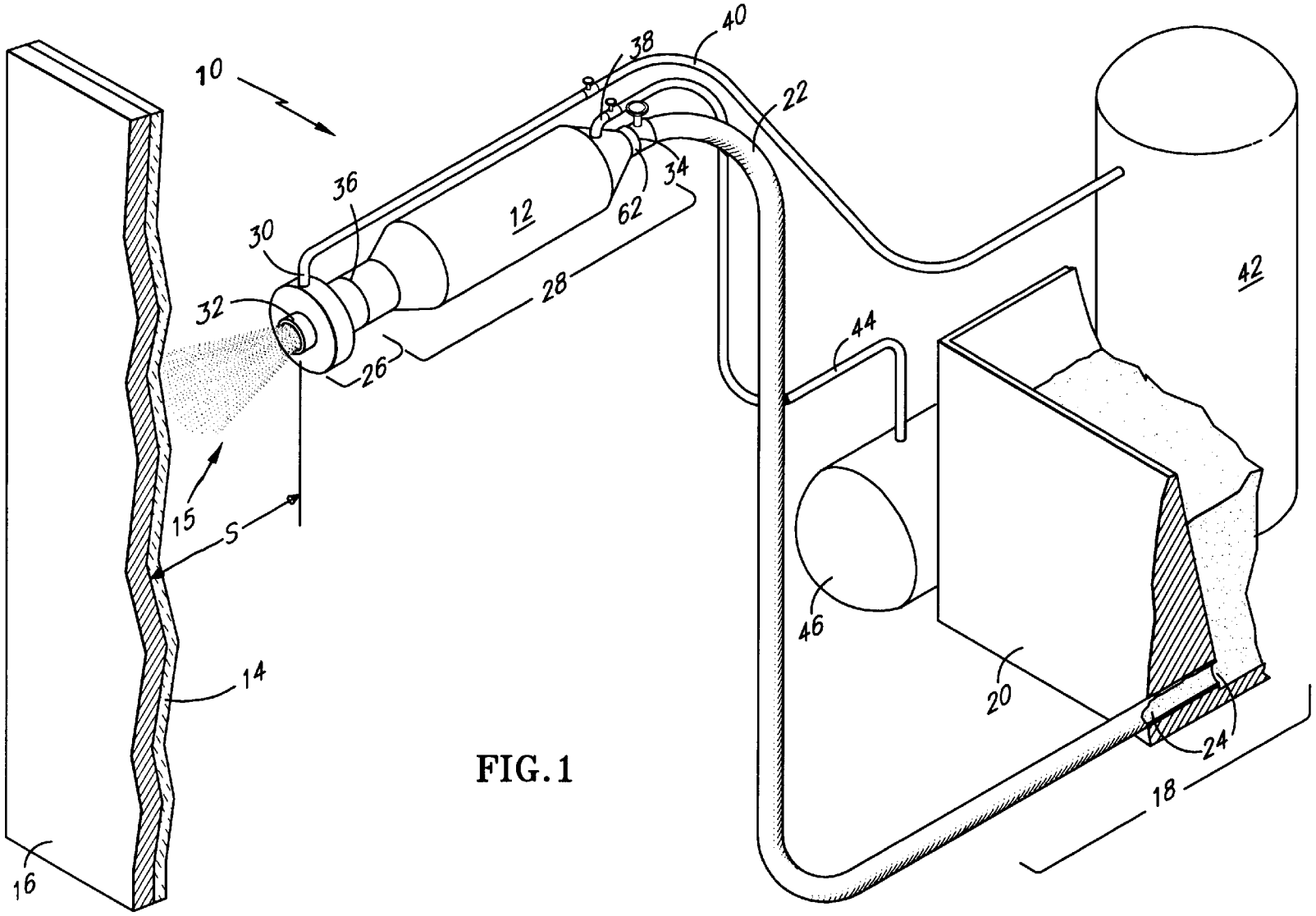
FIG. 1, is a perspective view of one embodiment of a spray system according to the present application shown in the operating mode.

Referring now in specific detail to the drawings, with like reference numerals identifying similar or identical elements, referring initially to FIG. 1, there is illustrated a perspective view of one embodiment of a spray system 10 of the present application shown in the operating mode. Spray system 10 applies wetted dry material droplets 15 onto a substrate 16 in the form of coating 14 and includes a spray apparatus 12 and a dry material feed assembly 18. Spray apparatus 12 preferably includes a nozzle 26 connected to a conveyance device 28. The dry material feed assembly 18 preferably includes a bin 20, which holds a dry material 24, and a conduit 22 for delivering the dry material from bin 20 to spray apparatus 12. As used herein, the term "dry" material refers to any material utilized with spray apparatus 12, prior to the material being wetted by a liquid delivered through nozzle 26.

With continued reference to FIG. 1, nozzle 26 includes an aperture (not shown) connected to a liquid inlet 30 for entry of a liquid into the nozzle, and includes an outlet 32 through which the wetted dry material droplets 15 exit. In the present embodiment liquid delivery hose 40 connects the liquid inlet 30 to a liquid supply 42.

Conveyance device 28 includes a dry material inlet 34 connected to conduit 22 and a dry material outlet 36. Dry material outlet 36 is located downstream of dry material inlet 34 and is connected to nozzle 26. The conveyance device 28 further includes an aperture (not shown) connected to an air inlet 38 for entry of a compressed air into the conveyance device. Air inlet 38 is connected to an air hose 44 at one end thereof, the air hose connecting the air inlet 38 to an air supply 46. The air supply 46 used is a conventional industrial air compressor capable of producing between about 125 to 150 psig air. The compressor should be designed for continuous operation, therefore, the compressor should have active cooling and lubrication. The preferred air compressors offer air-cooling and moisture removal from the compressed air through blow-down and desiccation, with point-of-use filters to further remove moisture and oil vapors from the compressed air. Two such compressors are manufactured by Ingersall-Rand and by Champion Corp, under the names HP-100 and HRA 30-12, respectively. The conveyance device 28 provides uniform conveyance of the dry material 24 from bin 20 to the dry material inlet 34, mixing currents (not shown) to aid in production of wetted dry material droplets 15, and uniform discharge of the wetted dry material droplets 15 from the outlet 32.

With continuing reference to FIG. 1, dry material feed assembly 18 includes conduit 22 which is connected at a first end to conveyance device 28 and is connected at a second end, opposite the first end, to bin 20. Conduit 22 is preferably connected at its first end to an inner enclosure 62 of conveyance apparatus 28 by a stub extension (not shown). The conduit, stub extension and inner enclosure all have complimentary inner and outer diameters to aid in the delivery of dry material from the conduit to the conveyance device. Alternatively, conduit 22 may be connected to inner enclosure 62 by a screw fitting, by machined recesses that accept thin sleeves which form protruding stubs, or any other conventional attachment method. Conduit 22 is connected at its second end to bin 20. The conduit is preferably connected to bin 20 by a hose clamp fitting, but alternately may be connected in any manner which will provide communication between the bin and conduit without leakage of dry material and which will not reduce the inside diameter of the conduit so as to create a check point.

The bin 20 or hopper to hold the dry material 24 preferably includes sloped side walls and a mechanical agitator (not shown) to break-up any dry material which may become caked or stuck together, prior to the dry material entering conduit 22. The sloped walls preferably are angled at about 60° to about 70° in order to minimize channeling of the dry material 24 while maximizing the useful volume of the dry material. In addition to having sloped side walls the bin 20 also preferably feeds to a single screw or twin screw discharge which provides a reasonably uniform discharge of the dry material from the bin 20 to conduit 22. The mechanical agitator, the bin 20 and the single or twin screw discharge are all conventional designs, readily available to one skilled in the art from a variety of sources including Acrison, Inc of Moonachie, N.J.

With continuing reference to FIG. 1, conduit 22 is preferably flexible and includes a relatively smooth bore (not shown) disposed therethrough. In the present embodiment, the inner diameter of the bore is preferably in the range of 1 to 2 inches, with approximately 1.625 inches especially preferred. The diameter of the bore is determined by several factors including, but not limited to; the type of material to be transported, the ability of the air compressor to provide sufficient air volume and pressure to transport the material and the cost to do so.

Conduit 22 may be constructed from a variety of thermoplastic materials, as long as the material utilized provides sufficient strength to preclude collapse of the conduit under the vacuum which is utilized for conveyance of the dry material 24 from the bin 20 to the nozzle 26. The preferred conduit material is also low in cost since this element can be subject to high wear. Preferred conduit materials include, but are not limited to, clear, fiber reinforced polyethylene, polybutylene or polybutadiene tubing. Various other materials may be employed, depending upon the preference of the designer. Some factors to consider during selection are functionality, cost, ease of manufacture, durability and the type material to be coated onto the substrate.

Figures 2, 3:
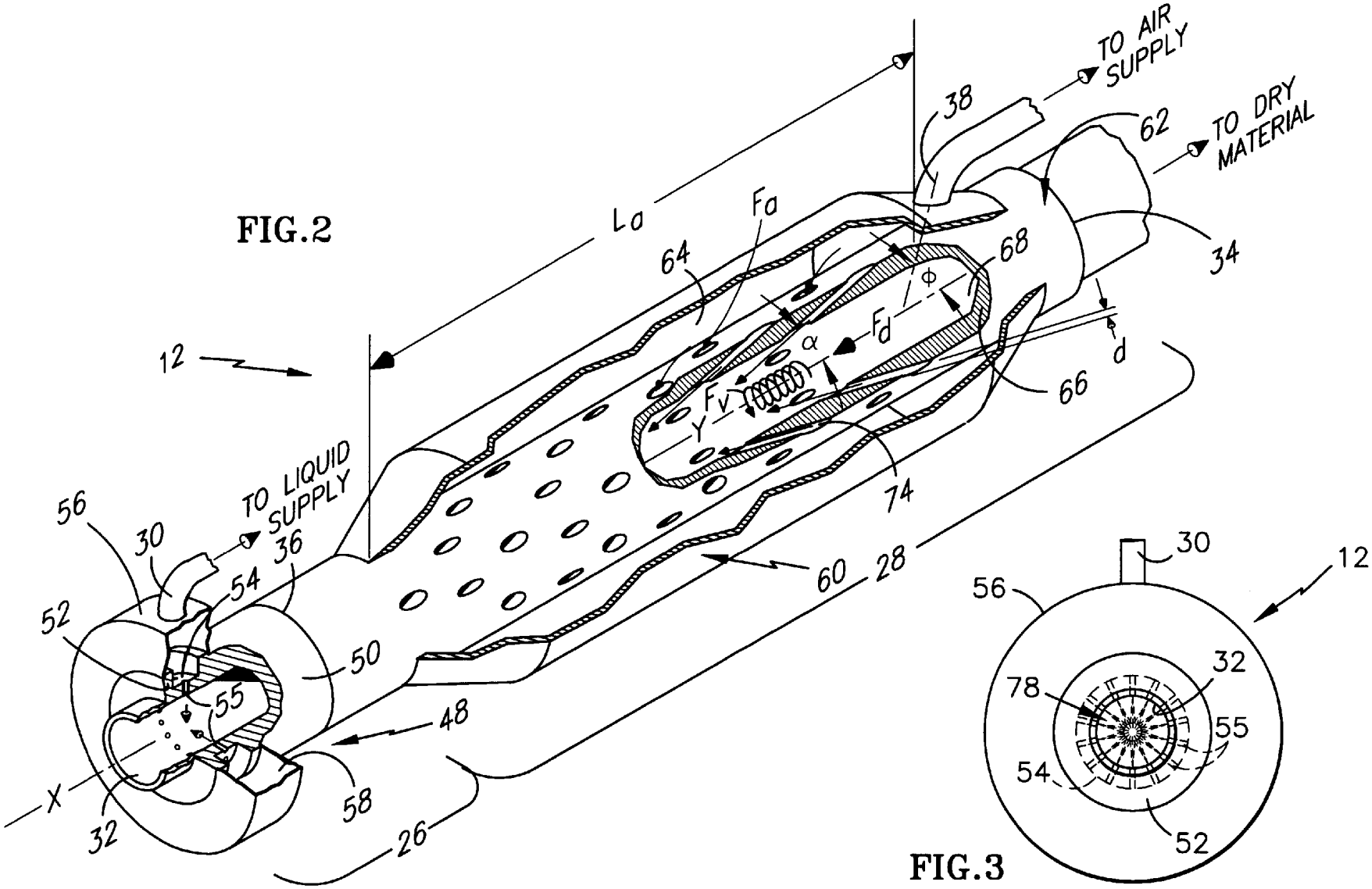
FIG. 2, is a perspective partially broken away and partially in section view of the spray apparatus of FIG. 1.
FIG. 3, is a front view of the spray apparatus of FIG. 1, shown in operative mode.

Referring now to FIG. 2, there is illustrated a perspective view partially broken away and partially in section of the spray apparatus 12. Nozzle 26 further includes connector 48 attached to dry material outlet 36 of conveyance apparatus 28. Connector 48 includes an upstream first section 50 adjacent the dry material outlet 36, a downstream second section 52 adjacent outlet 32 and a nozzle ring 54 welded therebetween. In the present embodiment first section, second section and the nozzle ring are preferably cylindrical and define a longitudinal axis "X" as shown in FIG. 2. Alternatively, connector 48 may by formed as a single member and may also be formed in a variety of shapes. Nozzle ring 54 preferably includes a plurality of circumferentially disposed injection holes, represented by the injection hole 55. The injection holes are most preferably distributed in a plane perpendicular to the longitudinal axis "X", at an equal radial distance from the longitudinal axis in order to maximize wetting of the dry material.

Nozzle 26 further includes a liquid enclosure 56 spaced apart from nozzle ring 54. Liquid enclosure 56 is preferably circumferentially disposed about the nozzle ring and partially disposed about first and second sections 50 and 52 adjacent the nozzle ring. The liquid enclosure 56 defines a liquid manifold 58 disposed between the liquid enclosure and the nozzle ring. Liquid enclosure 56 is preferably fitted about connector 48 by an interference fit and the seams are preferably sealed by foil or putty to prevent leakage through the liquid manifold 58. However, any method can be used to join these elements provided that the liquid does not leak through the liquid manifold 58.

With continuing reference to FIG. 2, the conveyance device 28 further includes an outer enclosure 60 substantially disposed about inner enclosure 62 thereby providing essentially an airtight air manifold 64 between the outer and inner enclosures. In the present embodiment, the outer and the inner enclosures are preferably cylindrical and are made of aluminum, although other shapes and materials may be utilized. Aluminum is the preferred material because it is inexpensive, easy to drill, easy to machine and facilitates attachment of the two enclosures by welding. Other materials that may be used are plastic, steel or any high strength low wear alloys with or without ceramic liners.

In the embodiment of FIG. 2, inner enclosure 62 includes an elongated tubular member 66 which has a longitudinally extending inner bore 68 disposed therethrough, bore 68 defining a longitudinal axis "Y", such that dry material inlet 34 and the dry material outlet 36 are spaced apart along the longitudinal axis "Y". In the present embodiment inner bore 68 has a continuous diameter. Inner enclosure 62 further includes an array of bores, represented by bore 74, disposed through tubular member 66, about the circumference thereof, in a random pattern. The array of bores extends substantially along the length of inner enclosure 62, the length being represented in the present embodiment as $L_a$. Bores 74 provide fluid communication of the compressed air between the air manifold 64 and the inner bore 68 as represented by the air flow arrow $F_a$.

Air manifold 64 functions to evenly distribute the compressed air to all of the bores; dampens any fluctuations in air flow due to pressure surges, dry material surges or plugged bores; functions to provide uniform distribution of the vacuum, as described further below, and uniform mixing within the inner chamber.

Each of the bores 74 includes an internal diameter "d", and is disposed at an angle a with respect to the longitudinal axis Y. The internal diameter d must be sufficient to allow the compressed air to flow from the air manifold 64 through bores 74, into inner bore 68 and out the dry material outlet 36, thereby producing a vacuum sufficient to transport a predetermined volume of the dry material to the nozzle outlet at a predetermined velocity, otherwise known as through put. In addition, the vacuum must also be sufficient to propel the dry material and the liquid from the nozzle onto the substrate (not shown). Bore angle $\alpha$ provides directional flow of the dry material toward the dry material outlet and is preferably angled to create mixing currents as the dry material is moved toward the dry material outlet 36. In the present embodiment the directional flow of the dry material is illustrated by the dry material flow arrow $F_d$. The mixing currents, or vortex effect, is represented by the flow line $F_v$.

It is preferred that the bore angle $\alpha$ be less than 90 degrees because if the bore angle is too large, the directional guidance and the vortex effect will be reduced, consequently, reducing the discharge rate from the nozzle and the turbulence of the flow $F_v$. Likewise, if the angle is too small the effectiveness of the directional guidance and the efficiency of mixing and discharge will be dampened. Therefore, it is preferred that the bore angle be between about 15° and 45°, and it is most preferred that the bore angle be about 30°.

The number of bores will vary depending on the desired through put. For example, a through put of approximately 12 cu. ft/hr requires approximately 56 bores. Likewise, the spacing of the bores also depends on the desired through put. The bores are preferably disposed in a random pattern, for maximization at the vortex effect which facilitates wetting of the dry material as described hereinbelow.

With continued reference to FIG. 2, outer enclosure 60 is connected to air inlet 38, upstream from nozzle 26. It is preferred that the inlet be positioned non-orthogonal with respect to the longitudinal axis Y so that tangential entry of the compressed air into the air manifold 64 is provided. Thus, the air inlet is preferably disposed at an angle $\phi$ with respect to the longitudinal axis "Y". In the present embodiment $\phi$ is approximately 35 to 45 degrees.

Referring now to FIG. 3, there is illustrated a front view of the spray apparatus 12 of the present application, shown in operative mode. Injection holes 55 extend through nozzle ring 54 and create a liquid screen 78 when the liquid flows through the injection holes 55, the liquid screen extending across the cross-sectional area of the nozzle ring 54. In the present embodiment there are 14 injection holes, with a separation angle of approximately 25° between each of the holes which is appropriate for connector 48 which, in the present embodiment has an inner diameter of about 1" to about 2.5". The number and optimum placement of the injection holes would depend on the diameter, type of dry material, flow rate of the liquid, flow rate of dry material, and liquid pressure. The injection hole size should, however, be small enough to produce desired discharge stream characteristics of the wetted material to a first order, or acceptable, degree of satisfaction. In this embodiment the injection holes are round, however other shapes may be used with different results. Liquid screen 78 provides for a high-velocity of impingement of the liquid with the dry material, creates very fine streams of the liquid and enough misting to insure that all of the dry material is at least wetted prior to ejection. Ideally the mixing regime is turbulent whereas the discharge stream of material has more laminar flow characteristics.

The operation of spray apparatus 12 will now be described with reference to FIGS. 1–3. Spray apparatus 12 can be held by an operator or the spray apparatus can be mounted using conventional mounting methods to move in the x-y plane on a pedestal robot of the type known by those of ordinary skill in the art. The substrate 16 to be coated may be any one of a variety of substrates having a variety of surface roughness. Surface roughness refers to the peak to valley heights and the average distance or period of the peak to valley transition on the substrate surface, and is preferred in the present application to improve adhesion of the coating to the substrate. The preferred substrate has a surface roughness is in the range of approximately 0.005" to 0.125", peak to valley surface roughness, as is known in the art. Some examples of substrates with which the system can be utilized include, but are not limited to, cinder blocks, poured concrete, chicken wire, rough stone, plywood, straw bales, styrofoam, stacked tires, cellulose batting, and rough-backed fiberglass composite. Regardless of the substrate utilized, the orientation of the substrate may be horizontal, vertical, overhead or somewhere in between.

The dry material selected preferably has a specific gravity in the range of about 0.25 (as for cork/cellulose) to abut 8.00 (as for ceramics/metals). The particle size of the dry material can range from 25 microns to 0.25 inches depending on the specific gravity of the dry material, the length of the conduit, and the motive pneumatic power provided by the air supply. In the present embodiment a cement/filler mixture is used as the dry material, however, a gypsum/filler mixture can also be utilized.

Referring now to FIGS. 2 and 3, the liquid supply for the present embodiment provides water with a viscosity of 1 cps to produce a cement or coating. Any other liquid with a comparable viscosity can be used with the nozzle 26 of this embodiment. The water in the present embodiment is flowed at a pressure in the range of approximately 20 to 65 psig, so that as the water passes through the liquid screen 78 a combination of turbulent diverging streams and mist is created. The liquid manifold 58 aids in evening out pressure variations for each of the injection holes 55, by being completely filled with liquid during operation. The water pressure should be monitored by using a flow meter or actual measurements to ensure that adequate water flow for proper impingement/wetting of the dry material occurs.

Referring now to FIGS. 1 and 2, air flows from the air supply 46 through the air hose 44 and through the air inlet 38 and into the air manifold 64. The air pressure at the inlet 38 is dependent on the specific gravity of the dry material used, the coating rate (i.e. rate at which a particular area is covered at a certain thickness ) and the relative standoff distance S, between the nozzle and the substrate. In the present embodiment the working range for the stand-off distance is approximately 12 to about 30 inches. Alternate stand-off distances are acceptable as long as a uniform spray pattern cross-section is achieved with acceptable taper of the coating thickness at the outer extremities. Reduced thickness at the periphery is to be expected but should be within acceptable limits as established for the particular application, as is known in the art.

If the air pressure at the air inlet is too strong there can be dramatic divergence of the powder when it leaves the nozzle outlet, thus causing poor adhesion to the substrate and excess scatter in the work area. Conversely, if the air pressure at the air inlet is too weak then there will be an insufficient vacuum created for the transfer of the dry material from the bin 20 to the dry material outlet 36. Thus, the air pressure should minimize divergence while producing a sufficient vacuum to achieve an acceptable flow rate. The nominal pressure range from the air supply to the air inlet is about 25 psig to about 110 psig. Pressure in the air manifold preferably ranges from 10 psig to about 50 psig.

The air from the air inlet 38 enters the air manifold 64 at a velocity that is dependent on the pressure at the air inlet, the diameter of the air inlet and the total cross-sectional area of the air manifold. The air velocity should be sufficient to create a back-pressure in the air manifold which increases airflow out of the manifold, such velocity resulting in a rise in the air manifold dynamic pressure. The air velocity should also be fast enough to create a sufficient vacuum to transport the dry material. In the present embodiment the air velocity is in the range of approximately 50 to 500 feet per second which is sufficient to achieve the aforementioned effects.

The air flows from the air inlet 38, into the air manifold 64, through bores 74, into the inner bore 68 and out the dry material outlet 36. The air flow from the air inlet which has a diameter of approximately 0.45" to about 0.50" through the small diameter bores 74 which are all angled in the same direction as shown in FIG. 2, creates a low pressure area behind the air entering the inner bore 68 which in turn creates the vacuum within the inner bore 68 that effectively draws the dry material from the bin 20 up the conduit 22 and into the conveyance device 28. The vacuum achieved by the air flow is weak about 5–15 inches of water or 0.4–1.2 inches of Mercury; however, this is strong enough to draw the dry material because of the pressure differential between the bin and the conduit and the entraining current of the air. If the length of the conduit increases the air volume and/or velocity will have to increase to create the same vacuum due to line losses and the mass in the line.

The dry material, once it flows into the dry material inlet 34, flows adjacent the bores 60. The dry material flow $F_d$ increases in velocity or accelerates, along $L_a$ and swirls because of the vortex effect. The swirling created by the vortex effect $F_v$ separates the dry material particles, consequently aiding in wetting of the dry material, because it increases the dry material surface exposed to the liquid downstream. The pressure at the dry material inlet in the present embodiment is about 26–27 Hg. Alternate pressure at the dry material inlet are possible as long as a satisfactory coating is achieved.

The accelerated and separated dry material particles are drawn through the dry material outlet 36 and into the nozzle 26. Referring to FIGS. 2 and 3, the dry material flows through the liquid screen 78 created by the flow of the liquid through the nozzle ring 54. A the material flows out of the nozzle outlet it emerges as a uniform stream of wetted dry material droplets 15 with sufficient velocity to provide good "splat" formation on impact with the substrate, i.e. sufficient flattening of the coating droplets as they impact the substrate, with minimum rebound. The formation of the wetted dry material droplets occurs as the dry material is mixed with the water at the liquid screen and in the turbulent flow immediately downstream of the nozzle outlet 36. The wetted dry material droplets are hydroscopic particles of dry material that have surface adsorbed the liquid. These wetted dry material droplets will adsorb the liquid and contact the substrate 16. The combination of velocity of the wetted dry material droplets and standoff combine to adhere the droplets to the substrate forming the coating 14. In time the coating cures to form concrete.

Wetting of the droplets can be modified and improved by adjusting the surface to volume ratio of the dry material to the liquid, water impingement, duration of exposure to the liquid between the liquid screen and substrate and by adjusting the turbulence within the inner chamber and at the nozzle outlet.

The dry material to water ratio is carefully monitored by a flow meter and controlled by operator controlled valves in order to obtain the desired wetted droplets and hence properties of the concrete, (i.e compressive strength and density). Proper mixing is verified by product testing, but is assumed based on consumption (retention) of the materials converged as a unit mass (minimum waste). The amount of waste will increase as the mixture ratio deviates above or below the nominal. This waste is generated by material bouncing off or sloughing off the substrate which-indicates a less than desirable mixture. On a vertical surface the adherence and build rate indicate the quality of mixing. In addition to the above, there may also be on-line control provided by either a flow controller, a motion controller, a thickness monitor or the like.

Thickness building occurs by transversing the substrate in a sweeping, horizontal or vertical motion. The rate of thickness building with vary with the materials used. For example, on a vertical surface with a standoff of 24 inches and a swath, or width, of about 4" a cork/cement mixture was sprayed at 4 feet per second with a thickness per pass of 0.125" and a transfer efficiency of about 80% (i.e. coating sticking). This yielded a deposition rate of approximately 48 sq. feet per minute at a thickness of 0.125" or 12 sq. feet per minute at a thickness of 0.5".

The spray system of the present application as described hereinabove provides for uniform conveyance of the dry material because the motive force created by the vacuum to move the dry material is substantially equal throughout the conduit. In addition, a conveyance device is provide which improves wetting of the dry material by creating a vortex effect which separates the dry material in an inexpensive manner, without moving parts. The present apparatus also eliminates concerns of pot-life, waste and product uniformity by wetting the dry material close to the nozzle outlet.

Another advantage of the present system is that it utilizes a relatively low vacuum because the point of wetting is located downstream, therefore the conveyance device moves the dry power not a more viscous and adherent liquid/powder mixture that would require a stronger vacuum.

Other advantages of the present apparatus include inexpensive construction, ease of manufacture, ease of use and cleaning, highly adjustable spray rates, ease of control of water-to-cement ratio, uniform coating thickness and greater deposition rates. In addition, strength of cement product, decreasing rebound and ability to blend many dry materials with conveyance device.

While a particular invention has been described with reference to illustrated embodiment, this description is not meant to be construed in a limiting sense. It is understood that although the present invention has been described in a preferred embodiment, various modifications of the illustrative embodiment, as well as additional embodiments of the invention, will be apparent to persons skilled in the art upon reference of this description without departing from the spirit and scope of the invention, as recited in the claims appended hereto. It is therefore contemplated that the appended claims will cover any such modification or embodiments that fall within the true scope of the invention.

We claim:

1. A spray system for application of a wetted dry material for applying a relatively thick coating to a substrate, comprising:

a nozzle, said nozzle having a liquid inlet through which a liquid enters; and a conveyance device attached to said nozzle, said conveyance device including:

an outer enclosure closed at its extreme ends, and an inner enclosure disposed substantially within said outer enclosure to provide an air manifold between said outer enclosure and said inner enclosure, said inner enclosure including:

an elongated tubular member having a longitudinally extending inner bore disposed therethrough, said bore defining a longitudinal axis;

a dry material inlet disposed along said longitudinal axis;

a dry material outlet spaced apart from said dry material inlet along said longitudinal axis, said dry material outlet being in communication with said nozzle;

an array of bores disposed through said tubular member of said inner enclosure and extending between said ends of said outer enclosure, said array of bores angularly disposed relative to said longitudinal axis and providing fluid communication of said compressed air between said air manifold and said longitudinally extending bore, each of said bores having an internal diameter, said internal diameter being sufficient to allow said compressed air to flow from said air manifold through said inner bore, thereby producing a vacuum sufficient to transport a predetermined volume of said dry material through said inner bore to said dry material outlet and into to said nozzle where said dry material is wetted by said liquid, said vacuum also being sufficient to propel said wetted dry material from said nozzle onto a substrate in order to coat said substrate with said wetted dry material.

2. The spray system of claim 1, wherein said array of bores are disposed at an angle equal to less than 90 degrees.

3. The system as claimed in claim 2 wherein said bore angle provides directional flow of said dry material through said inner bore, toward the dry material outlet by the action of the vacuum, said bore angle creating mixing currents.

4. The spray system of claim 1 wherein said angle is between 15 degrees to substantially equal to 45 degrees.

5. The spray system of claim 1, wherein said nozzle further includes a nozzle ring, said nozzle ring having a plurality of injection holes disposed therethrough.

6. The spray system of claim 5, wherein said nozzle further includes a liquid enclosure spaced from said nozzle ring.

7. The spray system of claim 6, wherein the space disposed between said liquid enclosure and said nozzle ring defines a liquid manifold.

8. The spray system of claim 7, wherein liquid passing from the liquid manifold, through said injection holes forms a liquid screen.

9. The spray system of claim 10, wherein said angle between substantially equal to 35 degrees to substantially equal 45 degrees.

10. Apparatus for applying a relatively thick coating to a substrate including a nozzle in combination with a conveyance device, said conveyance device having an inner enclosure and an outer disclosure coaxial and concentrically mounted relative thereto, said inner enclosure including a tube having a straight through bore, an array of bores disposed in said tube for defining air inlet for creating a vacuum adjacent to each of said bores of said array of bores, said outer enclosure being radially spaced from said inner enclosure for defining a manifold for receiving compressed air communicating with each of said bores of said array of bores, a material inlet at one end of said conveyance device for delivering a material to said bore of said tube, a material outlet axially spaced from said material inlet, said nozzle including a connector interconnecting said nozzle and said material outlet, a nozzle ring having a plurality of injection holes disposed therethrough, a liquid enclosure spaced from said nozzle ring, a liquid manifold disposed between said nozzle ring, wherein liquid passes through a liquid inlet into said liquid manifold to form a liquid screen, wherein said material is transported by said vacuum through said material outlet and into said nozzle where said material is wetted by passing through said liquid screen.

11. The spray apparatus as claimed in claim 10 wherein said vacuum propels said wetted dry material from said nozzle onto the intended substrate to coat said substrate with said wetted dry material.

* * * * *